US005796081A

United States Patent [19]

Carlsson et al.

[11] Patent Number: 5,796,081

[45] Date of Patent: Aug. 18, 1998

[54] MICROWAVE OVEN WITH TWO DIMENSIONAL TEMPERATURE IMAGE IR-SENSORS

[75] Inventors: Hakan Carlsson, Norrkoping; Mats Idebro, Linkoping, both of Sweden

[73] Assignee: Whirlpool Corporation, Benton Harbor, Mich.

[21] Appl. No.: 771,726

[22] Filed: Dec. 20, 1996

[30] Foreign Application Priority Data

Dec. 21, 1995 [SE] Sweden ..... 9504585

[51] Int. Cl.[6] ..... H05B 6/68

[52] U.S. Cl. ..... 219/711; 219/494; 99/325; 374/149

[58] Field of Search ..... 219/710, 711, 219/492, 494; 99/325; 374/149

[56] References Cited

U.S. PATENT DOCUMENTS

| | | | |
|---|---|---|---|
| 4,734,553 | 3/1988 | Noda | 219/711 |
| 4,737,917 | 4/1988 | Perron | 374/124 |
| 4,825,035 | 4/1989 | Moriyasu et al. | 219/121.61 |

FOREIGN PATENT DOCUMENTS

| | | | |
|---|---|---|---|
| 57-52724 | 3/1982 | Japan | 219/711 |
| 61-250422 | 11/1986 | Japan | 219/711 |
| 1-147224 | 6/1989 | Japan | 219/711 |

*Primary Examiner*—Philip H. Leung

*Attorney, Agent, or Firm*—Robert O. Rice; Stephen D. Krefman; Thomas A. Schwyn

[57] ABSTRACT

A microwave oven comprising a number of IR-sensors elements for obtaining temperature information from discrete sensing areas within the cooking zone of the oven and for generating a two-dimensional temperature image of the cooking zone. Based on said temperature image necessary load parameters may be calculated for controlling automatic heating procedures in the oven, thereby facilitating operation of the oven and securing a good cooking result.

12 Claims, 5 Drawing Sheets

MICROWAVE OVEN WITH TWO DIMENSIONAL TEMPERATURE IMAGE IR-SENSORS

BACKGROUND OF THE INVENTION

1. Field of the Invention

The invention is directed to a method for controlling a heating procedure in a microwave oven comprising an oven cavity, a microwave source for supplying microwaves to the oven cavity, means for obtaining heat radiation from a cooking zone of the cavity, and a control unit for controlling the supply of microwaves to the cavity dependent on said obtained heat radiation. The invention is also concerned with a microwave oven designed for operation in accordance with said method.

2. Description of the Related Art

In modem microwave ovens it is generally desirable to automatize the relevant cooking procedures as far as possible in order to facilitate handling by the user. Automatic cooking procedures require a feedback of information from the oven cavity about the current state of cooking of the food piece to the control unit thereof for controlling the microwave power supplied thereto. This feedback is obtained by means of different kind of sensors.

Accordingly, it is possible to supervise for example a reheating of a precooked food piece or beverage by using a so called humidity sensor. Then an estimate of the temperature of the food piece is based on the measured humidity. This means in practice that a mean value of the surface temperature of the food piece is obtained. Another possibility means that a weight sensor is used for sensing the weight of the food piece and changes thereof during the progressing cooking procedure. Still another possibility is the use of a combination of a humidity sensor and a weight sensor. Also in said last mentioned two examples the control function is based on estimated temperature mean values of the food piece.

Examples on prior art in which the oven control is based on sensing the humidity may be found in the microwave ovens manufactured and sold by the applicant under the type designations VIP34, VIP27, VIP20. The control method which has been used in said microwave oven types is disclosed in the Swedish patent No. SE 8604868-3. One prior art embodiment using weight sensors for controlling the cooking procedure has been used in a microwave oven manufactured and sold by the applicant under the type designation VIP34, and a more detailed disclosure thereof may be found in the Swedish patent application No. SE 9402061-7.

A different and more direct method for temperature information feedback is the use of a so called IR-sensor, sensing the heat radiation within the infrared spectral range emitted from the surface of the food piece. The heat radiation energy (E) emitted by the food piece is proportional to the absolute temperature raised to the fourth power, $(T)^4$, and the emissivity ($\epsilon$) of the food piece surface, which may be expressed by the following relation:

$$E \alpha \epsilon * T^4$$

The emissivity of the actual food pieces/beverages is typically around 0.9. By a simultaneous measurement of the temperature of the sensor itself, a value of the surface temperature of the food piece may be calculated.

The use of an IR-sensor in a microwave oven belongs to prior art. The IR-sensor is positioned in such a manner that the sensing area thereof covers a part of the surface which is covered by the food piece or a corresponding part of the rotating bottom plate in the microwave oven, provided such a plate is included. Normally the IR-sensor is positioned at the center of the cavity roof, the sensing area corresponding thereby typically an area of a diameter in the order of 8–10 cm. This situation has been illustrated in FIG. 2, in which the outer circle represents the circumference of the rotating bottom plate, the inner shadowed circular surface representing the sensing area of the IR-sensor. Provided that the surface of the food piece substantially covers the full sensing area of the IR-sensor a relatively correct measurement of the food piece temperature may be obtained.

The technical development in the area of IR-sensor control of microwave ovens has mainly been directed to partly the construction of the IR-sensor in itself, partly the arrangement of the IR-sensor in connection with the oven cavity and the leakage and interaction problems arising thereat, partly the control of the heat radiation from the cavity which is received by the IR-sensor, in order to secure that the IR-sensor is reached by "relevant" heat radiation, that is radiation from the food piece in the cavity, and that a relevant temperature value is furnished by the same. The patent literature in this field is fairly comprehensive and prior art may be exemplified by the following patent applications and patents: British patent application GB2, 184.834A, Offenlegungsschrift DE-OS 26 21 457A1, German patent DE 29 17 033C2, German patent DE 29 38 980C2, European patent application 0 024 798A2, European patent application 0 015 710B1, U.S. Pat. No. 4,383,157, U.S. Pat. No. 4,467,164, U.S. Pat. No. 4,360,723, U.S. Pat. No. 4,461,941, U.S. Pat. No. 4,751,356, and U.S. Pat. No. 4,245,143.

The prior art represented by said documents and different prior art based on measurement by IR-sensors have in common that a measurement of good quality of the temperature of the food piece is obtained provided that said condition is fulfilled, that is the surface of the food piece covering the complete sensing area of the IR-sensor. It is however obvious that this condition is not always fulfilled in the normal use of a microwave oven, having the consequence of problems and drawbacks in different applications.

Thus problems may arise if the food piece or the beverage, the temperature of which is to be measured during heating, is positioned in the cooking zone of the cavity in such a way that only a part of the same will fall within the sensing area of the IR-sensor. The temperature which is measured will then be erroneous because partly the temperature of the bottom plate will be sensed by the sensor. The error of the temperature measurement will depend on the amount of "false" surface which is sensed, that is not belonging to the food piece or the beverage, on the temperature of the bottom plate and the emissivity thereof. This case has been illustrated in FIG. 3, in which the central, circular area represents the sensing area of the IR-sensor and in which the full line circle may for example represent a cup of coffee falling partly outside the sensing area.

The situation disclosed in FIG. 3 has the consequence that the IR-sensor will not receive heat radiation from that part of the beverage or the food piece which falls outside the sensing area. This may lead to a most serious drawback, for example when heating a food piece represented by said circular line. Due to the so called "boarder heating effect" the hottest part of the food piece will then appear along the outer edge of the food piece and at the same time said hot parts of the food piece will partly fall outside the sensing area of the IR-sensor and therefore give no contribution to the temperature measurement. The consequence may then be burning the edge parts of the food piece.

A different problem in this context being what among skilled people is frequently named the "meatball problem", which means that the size of the surface of the relevant food piece or beverage is small compared with the sensing area of the sensor. Even if said "meatball" falls completely inside the sensing area of the sensor, the real temperature of the "meatball" will not be sensed but instead a temperature mean value of the total sensing area. Because the "meatball" has a heat-absorption capacity which is greater than that of the surrounding bottom plate, the consequence will be burning of the "meatball". It is understood that one possible way to improve the temperature measurement in this case is to decrease the sensing area of the IR-sensor such that it will be covered by the surface of the "meatball" to a larger extent. Because the sensing area in such a case will cover no more than a smaller part of the cooking zone, you may risk that the "meatball" is positioned within the cooking zone such that it will fall completely outside the sensing area with identical result, that is burning of the same.

The object of invention is to obtain an IR-sensor control of the cooking procedure in a microwave oven not having the drawbacks of prior art and allowing for a far-going automatization of a cooking procedure, and thereby a microwave oven having a high degree of user friendliness.

SUMMARY OF THE INVENTION

The object of invention is obtained by a method according to the introduction which is characterized by establishing a two-dimensional temperature image of the cooking zone by obtaining heat radiation from at least partly separated portions of the cooking zone by using a number of IR-sensor elements having each a discrete sensing area, the size of said sensing areas being fitted for obtaining temperature information from a smallest predictable spot load within the cooking zone, the number of portions which are sensed being adapted for the provision of said temperature image of a resolution allowing for an evaluation of actual temperature variations, load dependent parameters like a presence of load, type of load, extension of load, start temperature of load, temperature variations within the load surface as well as mean, maximum and minimum temperatures of the load being optionally established by means of pre-programmed decision algorithms based on said temperature image, said control information for controlling the microwave supply by said control unit being generated based on the load parameters thereby established from said two-dimensional temperature image.

By the method according to the invention it is possible to provide a fully automatic heating procedure combining in the one and same function reheating of precooked, frozen, room/refrigerator-temperatured food and beverage. In a modern type microwave oven these procedures are normally implemented by three different functions. From a user's point of view this means that the operation of the oven is drastically simplified because nothing more is required from the user than introducing the food piece into the oven cavity and starting the oven. Thereafter relevant procedures will be selected and performed fully automatically, thereby safeguarding an optimal cooking result as well.

A microwave oven according to the invention comprises an oven cavity, means for supplying microwaves into the oven cavity, a program controlled control unit for controlling the microwave supply dependent on temperature information from a food piece being cooked in the cooking zone of the cavity, and IR-sensor means for obtaining temperature information, and is characterized by a plurality of IR-sensor elements for obtaining heat radiation from said cooking zone, the sensing area of each sensor element covering a surface portion of the cooking zone being at least partly separated from the surface portions sensed by remaining sensor elements, said sensing areas being fitted for obtaining temperature information from a smallest predictable spot load, the number of sensor elements being adapted to the area of the cooking zone in order to allow temperature variations within the cooking zone to be obtained, the signal outputs of said IR-sensor elements being connected to the control unit for furnishing temperature information which is related to the heat radiation, said control unit being programmed to create a two-dimensional temperature image of the cooking zone from the temperature information which is received, said control unit controlling the microwave supply dependent on control parameters based on an evaluation of the temperature image.

The microwave oven according to the invention has the advantage that the cooking procedures in the oven may be performed automatically to a high degree by a further development of the program software of the existing program controlled control unit and by limited modifications of an existing oven design for the installation of a desirable number of IR-sensor elements.

One preferred embodiment of a microwave oven according to the invention, comprising a rotating bottom plate defining said cooking zone, and in which a number IR-sensor elements have been arranged in the cavity roof along a radius of the bottom plate, is characterized by said control unit being provided for periodical sampling of output signals of the IR-sensors, the sampling frequency being such that samples are obtained repeatedly during a revolution of the bottom plate and in such numbers that a continuous temperature image may be calculated. Thereby the advantage is obtained that it is possible to establish the temperature image of the complete bottom plate/cooking zone by the use of a limited number of sensors.

Further preferred embodiments of the invented method and microwave oven are evident from the appended claims.

The invention is based on the understanding that a substantially improved IR-sensor control may be obtained in a microwave oven by the use of a plurality of IR-sensor elements, having each a sensing area which is limited as such, thereby providing a temperature image of the cooking zone of the cavity and calculation of control parameters of the microwave supply to the cavity based on appearing temperature variations within the cooking zone. In a further development of a microwave oven according to the invention this kind of discrete temperature information from different parts of a food piece during cooking may be used for a direct control of the microwave supply to different parts of the oven cavity by the use of a distributed or distributing microwave feed system, for example of the kind disclosed in the Swedish patent SE 9302302-6 of the applicant.

BRIEF DESCRIPTION OF THE DRAWINGS

The invention will be described more closely in the following in connection with nonlimitative embodiments and by reference to appended drawings, in which.

Corresponding elements in the different Figures have been provided with the same references.

DESCRIPTION OF THE PREFERRED EMBODIMENT

Figure 1:
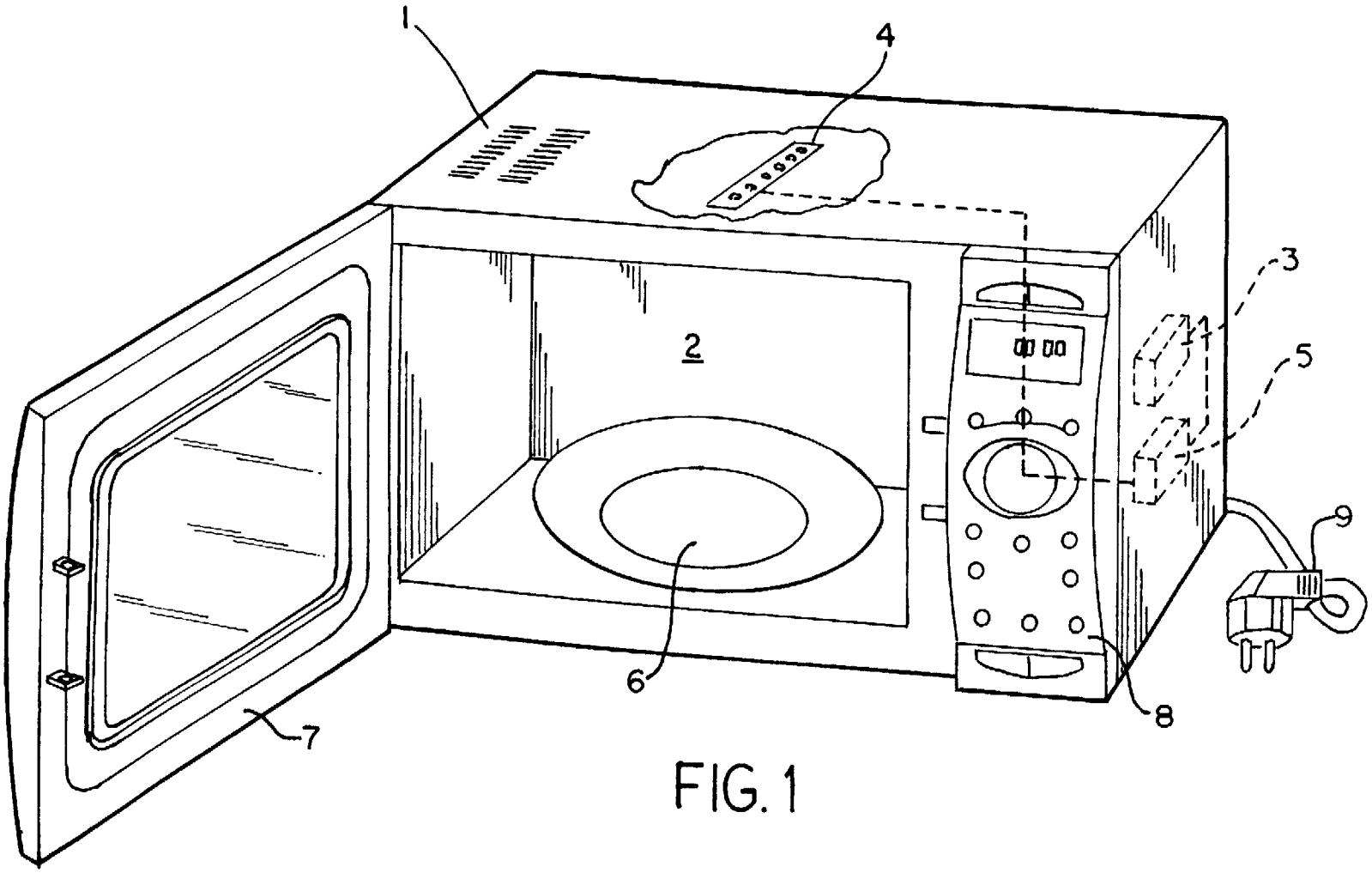
FIG. 1 discloses a schematical, partly opened view of a microwave oven according to the invention.

The design of a microwave oven 1 according to the invention which has been disclosed in FIG. 1 comprises an oven cavity 2, a microwave source 3 disclosed schematically by dotted lines and usually comprising a magnetron, a linear arrangement 4 of IR-sensor elements, being arranged in the roof of the cavity, a program controlled control unit 5 indicated by dotted lines, a rotating bottom plate 6, defining the cooking zone of the oven cavity in which the actual food piece or load is positioned, an oven door 7 for closing the cavity, an operating panel 8 having means for start and choice of cooking parameters, and a connector cable 9 provided with a connector plug for connecting the oven to the electric mains.

The control unit 5 is connected to the IR-sensor arrangement 4 for receiving temperature signals, and to the microwave source 3 for controlling the level of the output power thereof and its operation time according to current control programs of selected cooking procedures. These connections have been indicated by dotted lines. The more detailed mechanical and electrical design of the oven have no relevance for an understanding of the invention and therefore a detailed description thereof has been left out. In this connection may be referred to the microwave oven of type Whirlpool AVM 215, manufactured and sold by the applicant. This oven is provided with a grill element and has the following technical specifications: supply voltage 240 V/50 Hz; power consumption 2850 W; microwave power 1000 W; grill element power 1200 W; electronic timer; external dimensions 330×553×477 mm; oven cavity dimensions 227×375×395 mm; microwave power levels that may be selected by program control are 1000/850/750/650/500/350/160/90 W.

Figure 2:
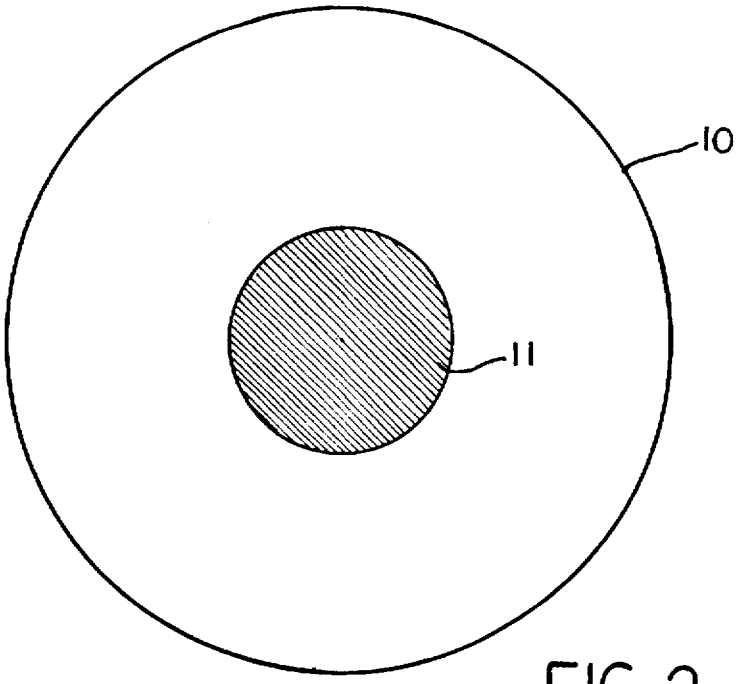
FIG. 2 discloses a schematical view from above of the rotating bottom plate of the microwave oven and the sensing area of the IR-sensor according to prior art.

FIG. 2 discloses a simplified view from above of the rotating bottom plate of a prior art microwave oven, in which the circumference of the bottom plate is illustrated by the circle 10. The oven comprises an IR-sensor arranged in connection with the cavity roof, of which the sensing area is indicated by the circular surface 11. Normally said sensing area has a diameter of 8–10 cm, which means that a small part only of the cooking zone represented by the bottom plate is sensed. In the case of an extended load or food piece this has the consequence that significant parts, and possibly the hottest parts, of the food piece will fall outside the sensing area and of this reason give no contribution to the temperature measurement. In the case of a point load or a food piece of a limited extension it may also occur that the same will fall completely or partly outside the sensing area of the IR-sensor. Both cases give undesirable consequences and generally a heating/cooking result which is not optimal.

Figure 3:
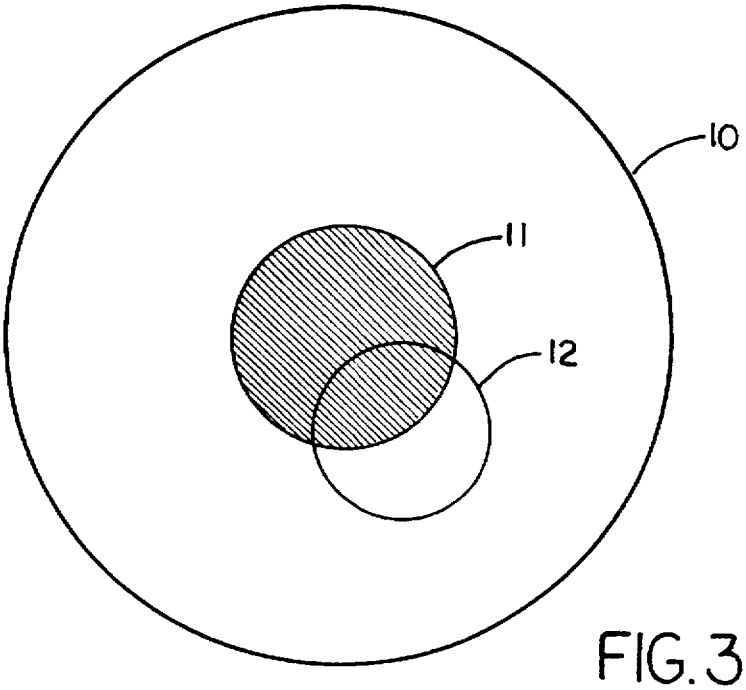
FIG. 3 discloses a view which corresponds to FIG. 2 with a load arranged on the bottom plate.

FIG. 3 illustrates an exemplifying operating condition of the prior art oven according to FIG. 2, in which a food piece or a beverage represented by the circular line 12 is positioned on the bottom plate such that it will partly fall outside the sensing area 11 of the sensor. In this case the sensor will sense a temperature mean value based on heat radiation from partly the part of the bottom plate which is exposed within the sensing area, partly that portion of the food piece which falls inside the sensing area. It may be understood that this temperature mean value may be a completely misleading value of the temperature of the food piece. If the food piece temperature is higher than the temperature of the bottom plate, being normally the case when reheating for example a food piece starting from room temperature, a temperature mean value is obtained which is below the value of the actual temperature of the food piece. In case of thawing of a deepfrozen food piece the reverse condition will appear, that is the IR-sensor will indicate a too high temperature value. In the case of an extended food piece so called "edge heating effects" may appear, which means that the edges of the food piece has a temperature which is higher than remaining parts of the food piece. Specifically in this case the consequences may be serious, because then the hottest parts of the food piece may appear outside the sensing area of the sensor and therefore burning of the parts of the food piece which fall outside may follow consequently.

Said problems in the oven according to FIGS. 2 and 3 may be reduced by arranging the IR-sensor such that it will have an asymmetric position in relation to the centre of rotation of the bottom plate. However, the problem remains that the IR-sensor in the case of an extended load still will sense no more than a part of the load surface and the fact that a temperature mean value within the viewing range or sensing area of the IR-sensor will be provided by the measurement and of this reason make it impossible to take into account the temperature variations appearing within the sensing area and/or the surface of the food piece.

Figure 4:
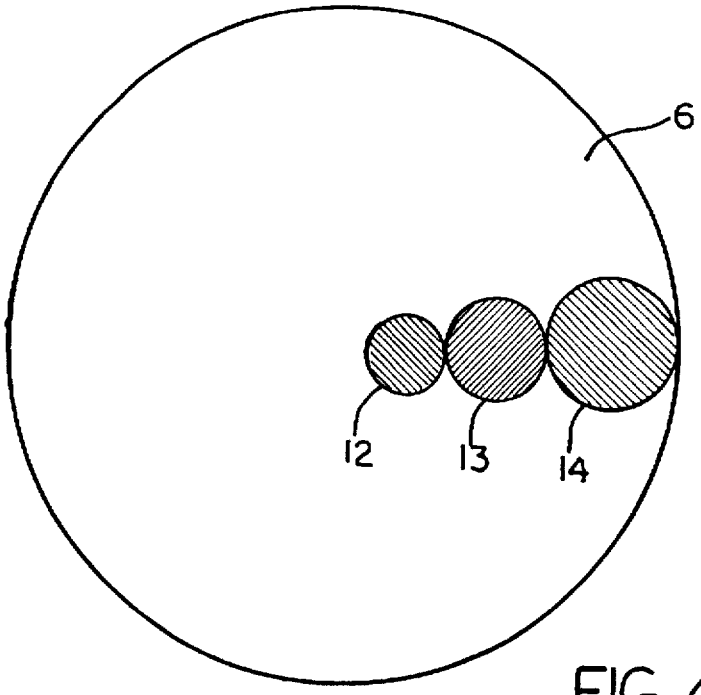
FIG. 4 shows a schematical view from above of the rotating bottom plate in a microwave oven according to the invention and the sensing areas of the IR-sensors thereof.

FIG. 4 discloses a view of the same kind as shown in FIGS. 2 and 3, that is the bottom plate or cooking zone 6 in a microwave oven according to the invention. The oven comprises three different IR-sensors being arranged in the cavity roof along a radius of the bottom plate (compare FIG. 1). The respective sensing areas of the IR-sensors have been marked by three hatched circular surfaces 12, 13, 14. As shown in the Figure the IR-sensors positioned at a greater distance from the centre of the bottom plate have correspondingly greater sensing areas. Thereby the covering of the sensing field is improved. At the calculation of the temperature values of the respective sensing areas the same are weighted in respect of the dimension of the sensing area for compensating the correspondingly greater amount of radiation which is received.

During the rotation of the bottom plate sampling takes place of the output signals of the IR-sensors and the obtained sampling values are furnished to the control unit. Sampling circuits for sampling the actual electric signals in order to obtain said sampling values are well known to the skilled man and therefore not further disclosed in this context.

Figure 5:
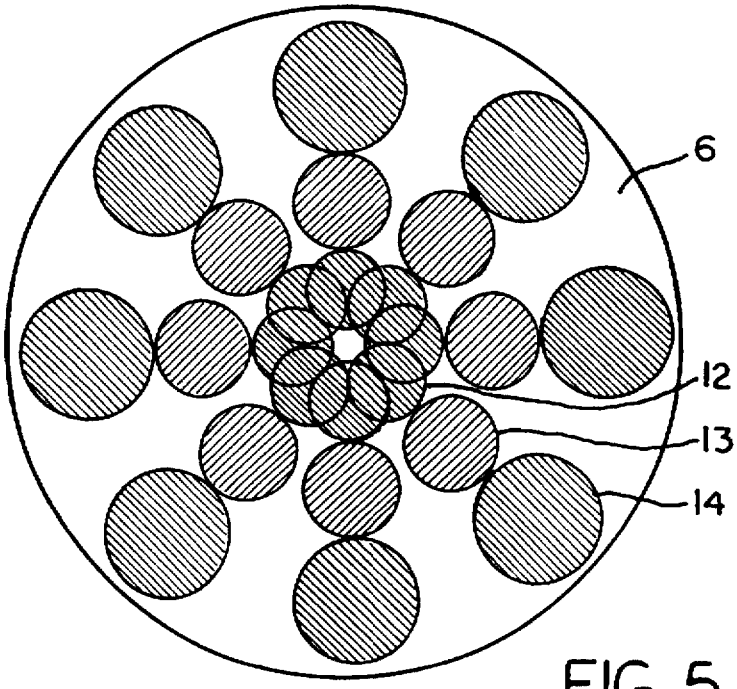
FIG. 5 illustrates the surface from which temperature information is obtained during one revolution of the bottom plate.

In one embodiment of the oven according to the invention the bottom plate has a revolution time which is 12 seconds. Choosing a sampling interval of 1.5 seconds, a situation is obtained which is illustrated in FIG. 5. This choice of revolution time and sampling interval means that the cooking zone/bottom plate is sampled eight times per revolution. In this Figure the shaded "sensing area circles" represent the surface parts of the bottom plate which are sensed during each revolution.

As clear from FIG. 5, already the use of three sensors and a sampling interval of 1.5 seconds provides for a covering which is comparatively good for obtaining the temperature information from the cooking zone. It may be understood that any desirable degree of covering up to a complete covering during the sensing operation may be obtained by a modification of the number of sensors, the sensing areas thereof and the sampling rate.

In the embodiment disclosed in FIG. 1 six IR-sensor elements have been used and a further embodiment of the oven according to the invention preferably uses 16 IR-sensors/sensor elements, allowing for a high quality coverage and the establishment of a temperature image of the cooking zone having a good degree of resolution in respect of actual temperature variations. An increased number of IR-sensors and an increased sampling rate obviously provide for an increased amount of information, being however not a problem in a microprocessor control unit of the type in question.

The temperature information is stored in the control unit as binary values in a memory matrix from which the temperature values may be retrieved by the use of associated address information, indicating the part of the cooking zone from which a respective temperature value emanates.

The temperature information which is stored in the memory may thereafter be processed in a way well known to the man skilled in the art by the use of pre-programmed algorithms in order to establish different parameters of the actual load/food piece, for example the type of load, that is if the load comprises one or a number of spot loads or one or possibly several extended loads, the extension of the load, the start temperature of the load, temperature variations within the load surface, the mean, the maximum and the minimum temperatures of the load, presence or not presence of a load in the cavity. Mainly the use of said algorithms means that the temperature information is sorted and/or compared with predetermined temperature thresholds and/or a mutual comparison. Knowing the structure of said algorithms and relevant conditions of decision, the development of the substantial program software of the control unit microprocessor is nothing else than skilled work of the same kind as the program software already used therein.

The result of said processing of the temperature information is used for the control of the microwave power supply to the oven cavity. In the actual type of microwave ovens the microwave power supply is usually subdivided into so called power cycles, having for example a duration of 20 seconds. The microwave source, being usually a magnetron, is activated during a desirable period of the power cycle at the nominal power level thereof and inactivated during a remaining part of the power cycle, said period being chosen in a manner such that the power mean value during the power cycle corresponds with a desirable power level. Using said power level control of the microwave oven according to the invention, the power mean value during each power cycle may preferably be influenced by the temperature information of said temperature image by controlling the length of said period of activation. In respect of power control of this kind as well as of a more sophisticated kind may be referred to the Swedish patent SE 9402309-0 of the applicant.

Figure 6:
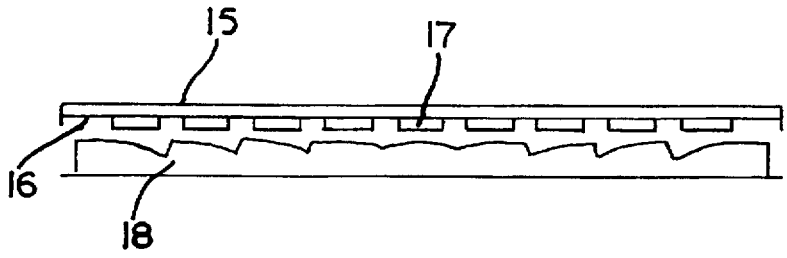
FIG. 6 shows the principle arrangement of a one-dimensional matrix of IR-sensor elements for sensing the cooking zone of a microwave oven according to the invention.
Figure 6:
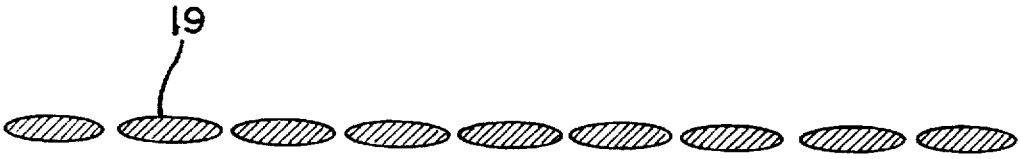

FIG. 6 discloses the principle design of a one-dimensional matrix 15 including nine IR-sensor elements 17, being arranged on one common chip 16. In front of the sensor matrix a Fresnel-type lens 18 has been provided, through which the heat radiation is received. By the action of said lens the total of the heat radiation which is received from the cooking zone is subdivided into nine sections, from which follows that the heat radiation from each one of the sensing areas 19 will reach a respective IR-sensor element 17. The matrix 15 may be arranged in such manner that said sensing areas will appear along a radius of the rotating bottom plate in correspondence with the disclosure of FIG. 1. Using a Fresnel lens allows for a compact design of the sensor arrangement on one chip while maintaining the coverage of sensing. In a further developed design said matrix may be two-dimensional such that the complete cooking zone, at least substantially, will be covered by the sensing areas of the sensor elements, thereby allowing for a temperature image of the invention to be obtained in as well an oven without said rotating bottom plate. For a more detailed presentation of the technology behind Fresnel-type lenses used in combination with IR-sensors, the field of motion sensitive IR-detectors may be referred to, said detectors being used for burglary alarm systems as one example.

Figure 7:
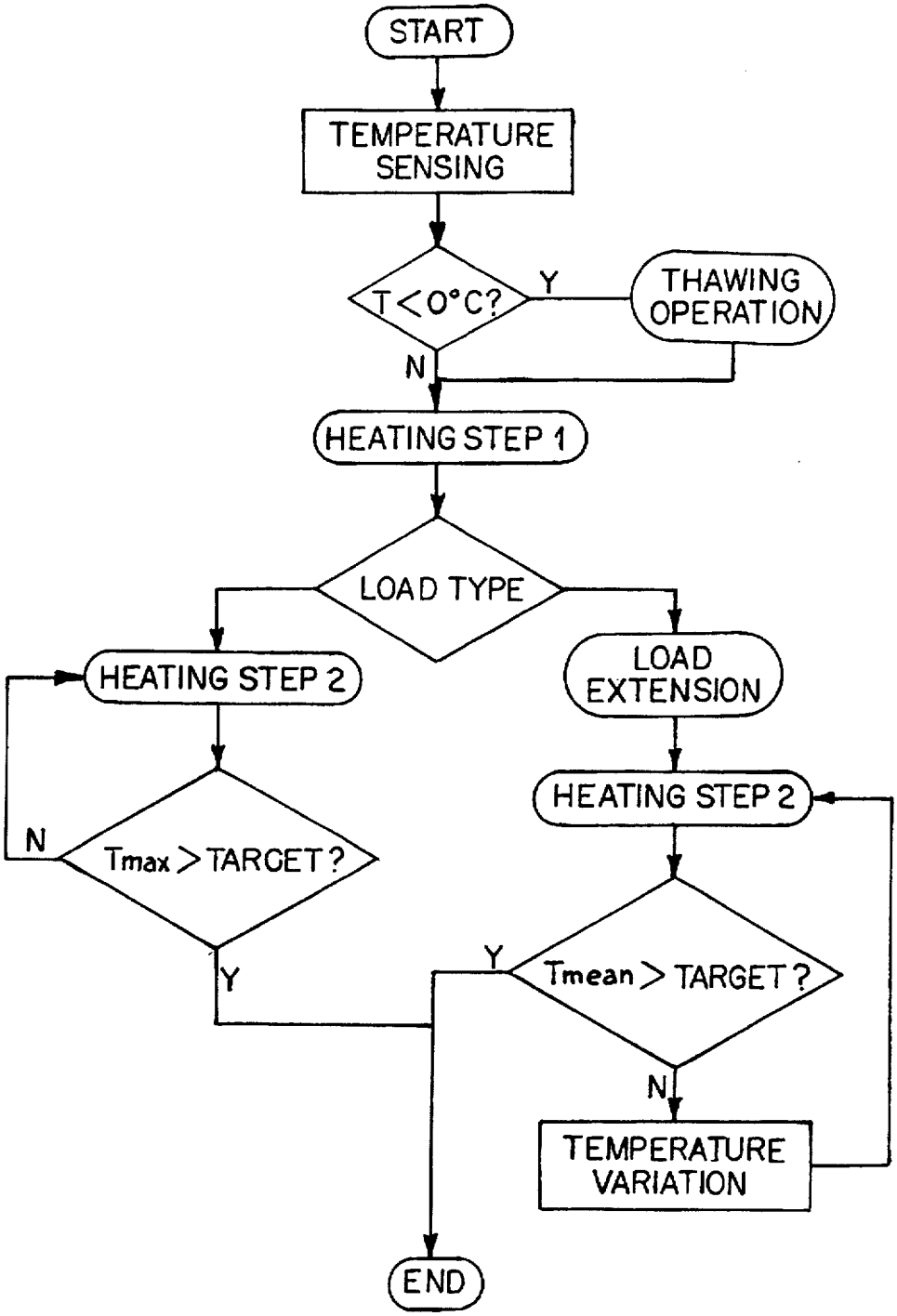
FIG. 7 discloses the program flow chart of an automatic cooking procedure in a microwave oven according to the invention.

FIG. 7 discloses the program flow chart of an automatic reheating/cooking procedure in a microwave oven according to the invention comprising a rotating bottom plate. The heating procedure may be divided into three subprocedures:

- a first subprocedure comprising start of oven, establishment of load start temperature, heating to a selected temperature, establishment of type of load, and corresponding to the steps which have been represented by the blocks S, a1–a5;
- a second subprocedure, in the case of a spot type of load (loads), comprising heating at a high power level while sensing the maximum temperature within the cooking zone, comparing the temperature which is sensed with a predetermined target temperature, interruption of heating when the target temperature is reached, and corresponding to the steps which have been represented by the blocks b1, b2, E;
- a third subprocedure in the case of an extended load, comprising establishment of the surface area of the load, heating at a selected power level while sensing the load temperature, comparing the mean temperature value of the load with a selected target temperature, selecting a power level dependent on a measured temperature variation within the load, ending the procedure when the target temperature is reached, and corresponding to the steps which have been represented by the blocks c1, c2, c3, c4, E.

Said first subprocedure may be described more in detail according to the following:

S: start heating procedure, go to a1, a1: after one revolution of the bottom plate, sense the load start temperature, go to a2 a2: any temperature value <0° C.?
If "yes" (Y), go to a3.
If "no" (N), go to a4.

a3: Change to thawing operation; continue heating at low power level while sensing the lowest temperature value within the cooking zone; when lowest temperature value >5° C., go to a4.

a4: Heating step 1:
choose ¾ of maximum power level
heat while sensing maximum temperature;
when maximum temperature >45° C., go to a5 a5: Establish type of load according to algorithm A by the following steps:
establish maximum temperature
establish a temperature mean value of the cooking zone establish difference between maximum temperature and temperature mean value compare temperature difference with a pre-set threshold value temperature difference > threshold value? establish the type of load to a spot load(s), go to b1 temperature difference < threshold value? establish type of load to an extended load, go to c1.

At the establishment of the type of load to spot load(s) the heating procedure changes into the second subprocedure according to the following:

b1: Heating step 2:

choose high power level sense temperature of only spot load(s) by sensing maximum temperature within the cooking zone during each revolution, go to b2 b2: compare maximum temperature with a predetermined target temperature:

maximum temperature > target temperature?

If "no" (N), return to b1

If "yes" (Y), go to E; heating fulfilled, interrupt procedure.

At establishing of the type of load to an extended load the heating procedure changes into the third sub-procedure according to the following:

c1: establish extension of load by evaluating the surface of the load using algorithm B, comprising the following steps:

establish an ambient temperature value choose a temperature threshold substantially higher than the ambient temperature value choose sensors having temperature values higher than temperature threshold choose sensors having sensing areas forming a continuous field of the cooking zone establish the surface area of the load to said continuous field choose power level =¾ maximum power go to c2 c2: Heating step 2:

heating at a selected power level sense temperatures only within established load extension during each power cycle, go to c3 c3: calculate a mean temperature value of the load as a temperature value weighted dependent on the sensing areas of the sensors; compare with pre-set target temperature:

mean temperature value > target temperature?

If "no" (N), go to c4

If "yes" (Y), go to E; heating fulfilled, interrupt procedure c4: establish temperature variation within load surface by following steps:

establish maximum temperature within load surface establish minimum temperature within load surface establish temperature variation as difference between maximum and minimum temperatures choose power level dependent on established temperature variation as follows:

* temperature variation <10° C.? choose full power, return to c2

* 10° C.≦ temperature variation <20° C.? choose ¾ full power, go to c2

* 20° C.≦ temperature variation <30° C.? choose ½ full power, return to c2

* temperature variation ≧30° C.? choose power =0, return to c2.

It may be understood, in case of, for example, a deepfrozen food piece having a temperature which is lower than the ambient temperature, that a temperature threshold which is lower than the ambient temperature is set instead in step c1 for establishing the extension of load.

The skilled man will understand that a temperature image of the cooking zone in the microwave oven according to the invention may be obtained in a number of different ways within the scope of invention, by choosing differently the number of IR-sensor elements, the sensing areas thereof and the sampling rate which is used in case the microwave oven is provided with a rotating bottom plate. Furthermore it stays within the competence of the man skilled in the art to propose variations of the control programs based on the temperature image and presented above, among other possibilities dependent on the resolution of the obtained temperature image and the aim of the actual heating/cooking procedures, all within the scope of the following claims and the idea of invention, namely the control of a heating procedure in a microwave oven dependent on actual temperature variations within the cooking zone of the oven.

We claim:

1. Method of controlling a heating procedure in a microwave oven comprising an oven cavity, a microwave source for supplying microwaves to the oven cavity, means for obtaining heat radiation from a cooking zone in said cavity, and a control unit for controlling the supply of microwaves into said cavity dependent on said obtained heat radiation, characterized by establishing a two-dimensional temperature image of the cooking zone by obtaining heat radiation from at least partly separated portions of the cooking zone by using a plurality of IR-sensor elements having each a discrete sensing area, the size of said sensing areas being fitted for obtaining temperature information from a smallest predictable spot load within the cooking zone, and in which the number of sensed portions have been adapted in order to provide said temperature image of a resolution allowing for an evaluation of actual temperature variations, establishing at least one load related parameter, from parameters including presence of load, type of load, extension of load, start temperature of load, temperature variations within surface of load and mean, and maximum and minimum temperatures of load, by means of pre-programmed decision algorithms based on said temperature image, and generating, based on the load parameters established in this manner from said two-dimensional temperature image, control information for controlling the supply of microwaves by means of said control unit.

2. A method as claimed in claim 1 for establishing the type of load, characterized by calculating a difference between an obtained temperature maximum and a temperature mean value weighted in respect of the cooking zone, comparing said temperature difference with a preset threshold value, establishing the type of load as one spot load or a number of spot loads if said temperature difference is greater than said threshold value, and establishing the type of load as one extended load or a number of extended loads if said temperature difference is lower than said threshold value.

3. A method as claimed in claim 2, characterized by continuing the heating procedure at a high power level while obtaining only the temperature of said one spot load, alternatively the mean temperature value of said spot loads, and interrupting the heating procedure when a target temperature value is reached by the sensed temperature.

4. A method as claimed in claim 1, for establishing the extension of load, characterized by establishing an ambient temperature value and a temperature threshold being substantially greater, alternatively substantially smaller, than said ambient temperature value, choosing sensors of which the temperature values are greater, alternatively smaller than said temperature threshold, selecting, from the sensors so chosen, the sensors having sensing areas forming a continuous field in said cooking zone, and establishing said continuous field as the extension of load.

5. A method as claimed in claim 4, using a cyclical supply of microwaves by power cycles of which the mean power value corresponds to a selected power level, characterized by continuing the heating procedure while obtaining temperature values from only the surface of extension of the load, calculating, during each power cycle, the mean temperature value of the load weighted in respect of the load extension, and comparing the same with a relevant target temperature, and interrupting the heating procedure when said mean temperature value becomes greater than said target temperature, alternatively continuing the heating procedure at a high power level if a small temperature variation within the extension of load is established from obtained temperature values, alternatively at a lower power level in case of a greater value of said temperature variation.

6. A method as claimed in claim 1, in which said microwave oven comprises a rotating bottom plate in said cooking zone carrying the load or food piece during cooking, each of said IR-sensor sensing areas appearing at a different radial distance from the centre of rotation of said bottom plate, characterized by sampling periodically the output signal of said sensors during a revolution of said plate, and establishing said two-dimensional temperature image from samples obtained during at least one revolution.

7. A microwave oven comprising an oven cavity, means for supplying microwaves to said oven cavity, a program controlled control unit for controlling the supply of microwaves dependent on temperature information of a food piece being cooked in the cavity cooking zone, and IR-sensor means for obtaining said temperature information, characterized by plurality of IR-sensor elements for obtaining heat radiation from the cooking zone, a respective sensing area of each of said sensor elements covering a surface portion of the cooking zone being at least partly separated from surface portions sensed by remaining sensor elements, said sensing areas being fitted for obtaining temperature information from a smallest predictable spot load, the number of sensor elements being adapted to the cooking zone area for allowing temperature variations within said cooking zone to be obtained, the signal outputs of said IR-elements being connected to said control unit for furnishing temperature information related to said heat radiation, said control unit being programmed for establishing a two-dimensional temperature image of the cooking zone based on the temperature information received, and said control unit being provided for controlling the supply of microwaves dependent on control parameters based on an evaluation of said temperature image.

8. A microwave oven as claimed in claim 7, in which said oven comprises a rotating bottom plate carrying the food piece, characterized by said IR-sensor elements being provided in the shape of a linear arrangement in the roof of said cavity and along a radius of said rotating bottom plate.

9. A microwave oven as claimed in claim 8, characterized by one of said IR-sensor elements which is positioned at a greater radial distance from the center of rotation of said bottom plate having a correspondingly increased sensing area in comparison with another one of said IR-sensor elements which is more closely positioned.

10. A microwave oven as claimed in claim 8, characterized by said IR-sensor elements being provided in the shape of a number of discrete IR-sensors, the number of elements being within the interval of 5–20.

11. A microwave oven as claimed in claim 7, characterized by said control unit being arranged for obtaining periodical samples of the output signals of said IR-sensor elements, and in case a rotating bottom plate is provided in the microwave oven, the sampling rate being such that samples are obtained repeatedly during a single revolution of the bottom plate and of such a number that a substantially continuous temperature image may be established.

12. A microwave oven as claimed in claim 7, characterized by said IR-sensor elements being arranged in the form of a two-dimensional matrix on a common chip, and a Fresnel-type lens being provided in front of said sensor matrix in order to provide said sensing areas adequately covering said cooking zone.

* * * * *